United States Patent [19]

Honders et al.

[11] Patent Number: 4,853,094

[45] Date of Patent: Aug. 1, 1989

[54] PROCESS FOR THE ELECTROLYTIC PRODUCTION OF METALS FROM A FUSED SALT MELT WITH A LIQUID CATHODE

[75] Inventors: Anthonie Honders; Alfred J. Horstik; Gerbrand J. M. Van Eyden, all of Arnhem, Netherlands

[73] Assignee: Shell Internationale Research Maatschappij B.V., The Hague, Netherlands

[21] Appl. No.: 167,753

[22] Filed: Mar. 15, 1988

[30] Foreign Application Priority Data

Apr. 1, 1987 [GB] United Kingdom ..... 8707782

[51] Int. Cl.[4] ..... C25C 3/26; C25C 3/30; C25C 3/32; C25C 3/34

[52] U.S. Cl. ..... 204/64 R; 204/66; 204/71

[58] Field of Search ..... 204/64 R, 66, 67, 71

[56] References Cited

U.S. PATENT DOCUMENTS

| | | | |
|---|---|---|---|
| 2,757,135 | 7/1956 | Gleave et al. | 204/71 |
| 2,861,030 | 11/1958 | Slatin | 204/64 |
| 2,919,234 | 12/1959 | Slatin et al. | 204/67 |
| 3,087,873 | 4/1963 | Slatin | 204/71 |
| 3,103,472 | 9/1963 | Slatin et al. | 204/67 X |

FOREIGN PATENT DOCUMENTS

| | | |
|---|---|---|
| 0039873 | 11/1981 | European Pat. Off. . |
| 660908 | 11/1951 | United Kingdom . |

OTHER PUBLICATIONS

Periodic Table of Elements.

*Primary Examiner*—John F. Niebling
*Assistant Examiner*—David G. Ryser
*Attorney, Agent, or Firm*—Jones, Tullar & Cooper

[57] ABSTRACT

A process for the production of metal Me or an alloy containing metal Me from a metal halide $MeX_n$ by electrolysis in a cell comprising an anode, a liquid metal cathode comprising one or more metals M and a liquid electrolyte comprising a salt melt of one or more alkali metal or alkaline earth metal halides, which comprises introducing metal halide $MeX_n$, in which Me represents a metal selected from the groups 2*b*, 3*b* (including the lanthanide series and the actinide series), 7*b* and 8 of the periodic system and Cr, Cu, Au, Ga, Sn, Pb and Bi, X represents halogen and n represents the valency of the metal Me, into the liquid metal cathode and isolating Me or an alloy containing Me from the metal cathode material.

19 Claims, 1 Drawing Sheet

PROCESS FOR THE ELECTROLYTIC PRODUCTION OF METALS FROM A FUSED SALT MELT WITH A LIQUID CATHODE

TECHNICAL FIELD

The invention relates to a process for the production of metal or alloys by electrolysis of metal halides in a cell comprising an anode, a liquid metal cathode and a liquid electrolyte.

BACKGROUND OF THE INVENTION

Winning metals by electrolysis in the presence of molten salts is an area in which increasing research is being carried out. An embodiment of this process is known from U.S. Pat. No. 2,757,135. In this event a metal halide, titanium tetrachloride, is supplied to the electrolysis cell by introducing into the salt melt. In practice, that process has to be carried out with a diaphragm that prevents the flow of titanium in lower valencies to the anode. If this were not done, the titanium would be re-oxidized at the anode to tetravelent titanium and would thus give rise to a loss of current and raw material. Furthermore, the build-up of titanium in the diaphragm shortens its life, which is a significant disadvantage.

SUMMARY OF THE INVENTION

The present invention proposes a process for the production of metal Me or an alloy containing metal Me from a metal halide $MeX_n$ by electrolysis in a cell comprising an anode, a liquid metal cathode comprising one or more metals M and a liquid electrolyte comprising a salt melt of one or more alkali metal or alkaline earth metal halides, which comprises introducing metal halide $MeX_n$, in which Me represents a metal selected from the groups *2b*, *3b* (including the lanthanide series and the actinide series), *7b* and 8 of the periodic table and Cr, Cu, Au, Ga, Sn, Pb and Bi, X represents halogen and n represents the valency of the metal Me, into the liquid metal cathode and isolating Me or an alloy containing Me from the metal cathode material.

BRIEF DESCRIPTION OF THE DRAWINGS

The invention will be discussed in more detail with reference to FIGS. 1 and 2, which illustrate possible electrolytic cells, taking the electrolysis of tin tetrachloride to produce metallic tin in a liquid zinc cathode as example.

DETAILED DESCRIPTION OF THE PREFERRED EMBODIMENTS

Figure 1:
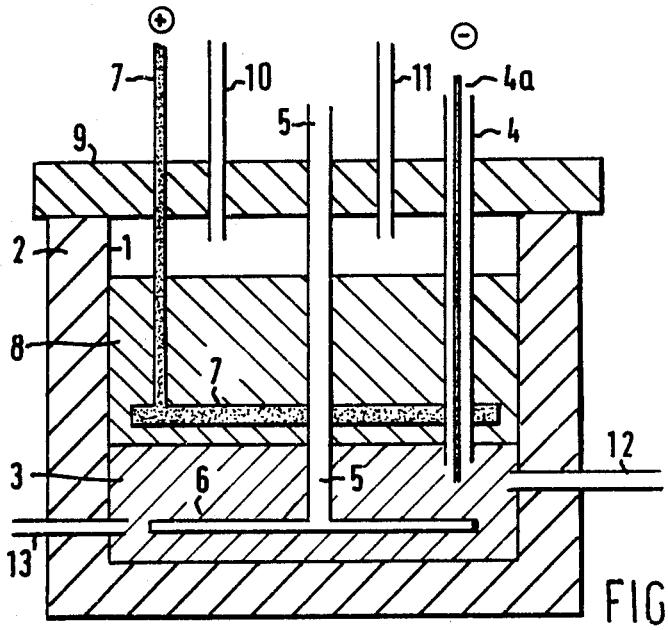
FIG. 1 is a cross-sectional view of an electrolytic cell in accordance with one embodiment of the invention.

In FIG. 1 cell 1 is in a jacket of thermally insulating material 2, for example refractory brick. Cathode 3 consists of liquid zinc to which current is fed via insulating pipe 4 and feed rod 4a. Supply of tin tetrachloride takes place via pipe 5 and distributor 6, for example a metal grid with outlets at intervals or a body of porous ceramic material. Anode 7 is positioned in electrolyte 8 near the interface between cathode and electrolyte. The horizontal surface area of the anode is chosen to be as large as possible. Electrolyte 8, for example a lithium chloride/potassium chloride melt, is heated to a high temperature, for example 350° to 900° C. or higher if operations are carried out under pressure. Through lid 9 runs a supply pipe 10 for inert gas, for example argon, and a discharge pipe 11 for chlorine gas which is generated at the anode. The current and the supply of tin tetrachloride are adjusted to match each other such that all or substantially all tin is reduced in the cathode, thus forming a zinc/tin alloy. This means that the anode does not need to be shielded by a diaphragm. This can be achieved with, for example a current of at least 4 Faraday per mol tin tetrachloride. Vaporization of tin tetrachloride before its introduction into the cathode is not necessary, since its temperature rises in any case to above its boiling point (114° C.) during its passage through the salt melt. If desired, the cell can also be provided with means for temperature control of the process. The space above electrolyte 8 can also be cooled or any vaporized salt melt of zinc can be internally or externally condensed and fed back. Supply and discharge of cathode liquid takes place via lines 12 and 13, in particularly in the continuous embodiment. The tin content in the Zn/Sn alloy will be allowed to increase to a predetermined value. Recovery of tin metal from the alloy may be carried out by conventional methods, e.g. by distilling off cathode metal or metal Me.

Figure 2:
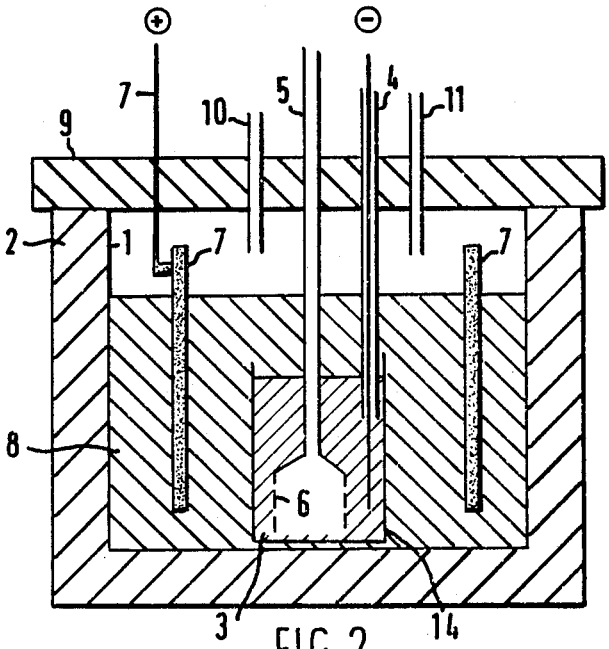
FIG. 2 is a cross-sectional view of an electrolytic cell in accordance with another embodiment of the invention.

FIG. 2 shows a cell with a vertically positioned anode. The same reference numerals have been retained for the same elements of the construction. In the salt melt a tray 14 is placed in which liquid zinc is present. Tin tetrachloride vapour now enters via perforations in the lower part of supply pipe 5. Anode 7 is constructed as a closed cylinder which completely surrounds the cathode.

Although in the preceding section the process of this invention has been described by reference to a preferred embodiment, i.e. production of tin from tin tetrachloride employing a liquid zinc cathode, the invention is not limited thereto. Analogous processing can be carried out with different cathode materials, i.e. cadmium, aluminium, tin, lead, indium, bismuth and gallium. Zinc, tin and lead are preferred. Likewise other feedstocks may be processed, i.e. halides of Zn, Cd, Hg, Sc, Y, La, the lanthanide series (especially Nd and Eu) Ac, the actinide series (especially U) Mn, Tc, Re, Fe, Ru, Os, Co, Rh, Ir, Ni, Pd, Pt, Cr, Cu, Au, Ga, Sn, Pb and Bi. Preferred metal halides to be processed are those of Zn, La, Nd, Eu, U, Co, Pt, Cr, Sn and Pb. The preferred halogen atom is chlorine, as it is for the molten salt compositions.

It is not known to what extent the production of metal Me proceeds via direct electrolytic conversion. Introduction of the metal halide into a liquid metal cathode at elevated temperature may result in a chemical reduction of metal Me to lower valencies, this may then be followed by electrolytic reduction of lower valent metal to the (zerovalent) metal, coupled with electrolytic regeneration (reduction) of cathode material. Such combined chemical and electrolytic reductions of metal Me in a higher valency to zerovalent metal are included expressis verbis in the scope of this invention. What is essential to this invention is the application of an electrolytic cell with a liquid metal or alloy cathode, an introduction of metal halide $MeX_n$ directly into the liquid cathode and production of (zerovalent) metal Me within the cathode material, the latter as distinguished from production of metal Me somewhere else, i.e. in the molten salt electrolyte or by deposition on a second or auxiliary cathode. As will be clear from FIGS. 1 and 2 the cathode is not of bipolar construction, but is a conventional monopolar cathode. Absence of a diaphragm is also important.

The salt melts may be free from impurities but this is not strictly necessary, while in addition it may be advantageous to work under an inert atmosphere of, for example, argon or nitrogen. Examples of suitable salt melts are LiCl/NaCl, NaCl/KCl, LiCl/KCl, LiCl-/$CaCl_2$, NaCl/$BaCl_2$ and KCl/$CaCl_2$, but, as has already been pointed out, the invention is not limited to the above-mentioned melts.

In principle, suitable processing temperatures are above the melting point of the cathode material and below the temperature at which that material has such a vapour pressure that undesirably large losses occur. Preferred temperatures are between 350° and 900° C., for zinc 425° to 890° C., for cadmium 350° to 750° C. Similarly, the processing temperature should not be so high that loss of molten salt electrolyte or metal Me by evaporation or decomposition becomes substantial.

The current and the supply of metal halide feedstock are so adjusted that complete reduction of metal Me in the cathode can take place. Preferably, at least n $F.mol^{-1}$ metal halide $MeX_n$ is supplied, n being the valency of the metal. The current is, however, restricted to a certain maximum, since net deposition of salt-melt metal in the cathode should preferably be prevented as far as possible. The feedstock should preferably be introduced under homogeneous distribution into the cathode. The easiest way for achieving this is by using feedstocks that are in gaseous form on the moment of their introduction into the cathode material. However, introduction into the cathode of compounds in finely dispersed, solid or liquid form is also included within the scope of this invention. This all results in no metal Me, or practically none, in any valency ending up in the salt melt. It is then not necessary to employ a diaphragm to shield the anode, so that no undesired current, feed stock and voltage losses occur, resulting in great technical and economical benefits. Cells having no diaphragm are preferred.

To isolate metal Me or alloys containing Me, liquid metal cathode material is withdrawn from the electrolysis cell. In this respect it is remarked that, depending on the metal halides $MeX_n$ and cathode metals M used, sometimes a liquid alloy is obtained, sometimes solid intermetallic particles in the liquid cathode metal are obtained, and sometimes a two phase liquid or liquid/-solid system is obtained, when the solubility of one metal in the other is low, or complex systems are formed comprising mixtures of the possibilities described hereinbefore.

The invention is elucidated below by a number of experiments.

EXAMPLE I a. 1.5 kg of eutectic LiCl/KCl mixture (59:41 mol) was purified by passing HCl gas through it at above its melting point for 8 hours. The HCl forces the equilibria a) and b) shown below to the left, so that an anhydrous, almost oxygen-free melt is obtained.

(a) $Cl^- + H_2O \rightarrow HCl + OH^-$ (b) $2Cl^- + H_2O \rightarrow 2HCl + O^{2-}$ Residual oxygen compounds and metallic impurities are then removed by electrolysis under vacuum at a cell voltage of 2.7 V.

An electrolytic cell of externally heated stainless steel was employed with a molten zinc cathode (90 g) which was placed in a holder of $Al_2O_3$ on the bottom of the cell. A graphite rod served as anode, no diaphragm was used and 250 g salt melt was used as electrolyte. The cell voltage was 5.0 V, the cathode potential was −2.0 V (relative to an Ag/AgCl reference electrode) and the other conditions are given in the Table.

The $SnCl_4$ was injected as a liquid in an argon stream and fed into the cathode. An argon atmosphere was maintained above the salt melt. In all experiments a current of 6 $F.mol^{-1}$ $SnCl_4$ was employed.

The following results were determined by microprobe and chemical analysis of the cooled cathode products and electrolyte.

TABLE

| Cathode | Feedstock | Temp. | Time | Feedrate | Current | Current density | Cathode analysis (% m/m) | | | | Electrolyte analysis (% m/m) | |
|---|---|---|---|---|---|---|---|---|---|---|---|---|
| M | $MeX_n$ | (°C.) | (min) | ($ml \cdot hr^{-1}$) | ($F \cdot mol^{-1}$) | ($A \cdot cm^{-2}$) | M | Me | Li | K | M | Me |
| Zn | $CrCl_3$ | 800 | 180 | * | — | 1 | >90 | ** | n.d. | n.d. | n.d. | n.d. |
| Zn | $SnCl_4$ | 800 | 150 | 3.7 | 6.0 | 1 | 88 | 6.7 | 1.89 | <0.3 | 0.23 | 0.092 |
| Zn | $NdCl_3$ | 850 | 240 | * | — | 1 | 89 | 5.6 | 2.2 | 0.6 | 0.039 | 0.008 |
| Zn | $PbCl_2$ | 720 | 60 | * | — | 1 | 87 | 4.3 | 0.47 | n.d. | n.d. | n.d. |
| Zn | $CoCl_2$ | 850 | 60 | * | — | 1 | 83 | 9.8 | 0.23 | n.d. | n.d. | n.d. |
| Zn | $PtCl_4$ | 720 | 60 | * | — | 1 | 90 | 9.1 | 0.36 | n.d. | n.d. | n.d. |
| Zn | $LaCl_3$ | 720 | 60 | * | — | 1 | 89 | 5.2 | 0.51 | n.d. | n.d. | n.d. |
| Zn | $EuCl_3$ | 720 | 60 | * | — | 1 | 87 | 5.2 | 0.77 | n.d. | n.d. | n.d. |
| Zn | $UCl_4$ | 720 | 60 | * | — | 1 | 85 | 6.9 | 0.80 | n.d. | n.d. | n.d. |

Electrolyte: LiCl/KCl
* = No continuous feed
** = Me metal proven with SEM/EDS
n.d. = not determined

We claim:

1. A process for the production of metal Me or an alloy containing metal Me from a metal halide MeXn by electrolysis in a cell comprising an anode, a liquid metal cathode comprising one or more metals M and a liquid electrolyte comprising a salt melt of one or more alkali metal or alkaline earth metal halides, which comprises: introducing metal halide MeXn directly into the liquid metal cathode; and withdrawing Me or an alloy containing Me from the metal cathode material, wherein Me represents a metal selected from the groups **2*b*, 3*b* (comprising the lanthanide series and the actinide series), 7*b* and 8** of the periodic table and Cr, Cu, Au, Pb, Sn and Bi, x represents halogen and n represents the valency of the metal Me.

2. A process as claimed in claim 1, in which Me is a metal from group **2*b*** of the periodic table.

3. A process as claimed in claim 1, in which Me is a metal from group **3*b***, comprising the lanthanide series and the actinide series, of the periodic table.

4. A process as claimed in claim 1, in which Me is a metal from group 7*b* of the periodic table.

5. A process as claimed in claim 1, in which Me is a metal from group 8 of the periodic table.

6. A process as claimed in claim 1, in which Me is Cr, Cu, Au, Pb and Bi.

7. A process as claimed in any one of claims 1 to 6, in which X represents chlorine.

8. A process as claimed in claim 7, in which M is Zn, Cd, Al, Sn, Pb, In, Bi and Ga.

9. A process as claimed in claim 8, in which M is selected from Zn, Sn or Pb.

10. A process as claimed in claim 8, which is carried out in an electrolytic cell having no diaphragm.

11. A process as claimed in claim 7, in which metal halide MeXn is distributed in gaseous form directly into the liquid cathode material.

12. A process as claimed in claim 7, which is carried out in an electrolytic cell having no diaphragm.

13. A process as claimed in any one of claims 1 to 6, in which M is Zn, Cd, Al, Sn, Pb, In, Bi and Ga.

14. A process as claimed in claim 13, in which M is Zn, Sn or Pb.

15. A process as claimed in claim 13, in which metal halide MeXn is distributed in gaseous form directly into the liquid cathode material.

16. A process as claimed in claim 13, which is carried out in an electrolytic cell having no diaphragm.

17. A process as claimed in any one of claims 1 to 6, in which metal halide $MeX_n$ is distributed in gaseous form directly into the liquid cathode material.

18. A process as claimed in claim 17, which is carried out in an electrolytic cell having no diaphragm.

19. A process as claimed in any one of claims 1 to 6, which is carried out in an electrolytic cell having no diaphragm.

* * * * *